US009609906B2

(12) United States Patent
Schatz et al.

(10) Patent No.: US 9,609,906 B2
(45) Date of Patent: Apr. 4, 2017

(54) HOCKEY SKATE SHIELD

(71) Applicant: Magna Closures Inc., Newmarket (CA)

(72) Inventors: Kurt Schatz, Uxbridge (CA); J. R. Scott Mitchell, Newmarket (CA); Michael Smart, Keswick (CA)

(73) Assignee: MAGNA CLOSURES INC., Newmarket (CA)

( * ) Notice: Subject to any disclaimer, the term of this patent is extended or adjusted under 35 U.S.C. 154(b) by 0 days.

(21) Appl. No.: 14/323,056

(22) Filed: Jul. 3, 2014

(65) Prior Publication Data

US 2015/0028576 A1 Jan. 29, 2015

Related U.S. Application Data

(60) Provisional application No. 61/858,242, filed on Jul. 25, 2013, provisional application No. 61/888,262, filed on Oct. 8, 2013.

(51) Int. Cl.

| | |
|---|---|
| ***A63C 3/00*** | (2006.01) |
| ***A63C 3/02*** | (2006.01) |
| ***A43B 5/18*** | (2006.01) |
| ***A43B 5/16*** | (2006.01) |

(52) U.S. Cl.

CPC . *A43B 5/18* (2013.01); *A43B 5/16* (2013.01)

(58) Field of Classification Search

CPC ..... A63C 3/00; A63C 3/02
USPC ..... 280/811
See application file for complete search history.

(56) References Cited

U.S. PATENT DOCUMENTS

| | | | | |
|---|---|---|---|---|
| 2,029,787 | A | 2/1936 | Ohler | |
| 3,806,145 | A | 4/1974 | Czeiszperger | |
| 4,351,537 | A * | 9/1982 | Seidel | A43B 5/1616 280/11.12 |
| 4,445,287 | A | 5/1984 | Garcia | |
| 5,234,230 | A * | 8/1993 | Crane | A63C 3/00 280/811 |
| 5,829,170 | A | 11/1998 | Lutz, Jr. | |
| RE37,887 | E | 10/2002 | Yates | |
| 6,769,203 | B1 | 8/2004 | Wright et al. | |
| 6,854,200 | B2 | 2/2005 | Hipp et al. | |
| 7,021,663 | B1 | 4/2006 | Moran | |
| 7,127,836 | B1 * | 10/2006 | Jamison | A43B 3/16 36/1.5 |
| 7,398,609 | B2 | 7/2008 | Labonte | |

(Continued)

FOREIGN PATENT DOCUMENTS

| | | | |
|---|---|---|---|
| CA | 2026434 | A1 | 9/1990 |
| EP | 1384568 | A1 | 1/2004 |
| EP | 2250914 | A1 | 11/2010 |

OTHER PUBLICATIONS

European Search Report Feb. 20, 2015.

*Primary Examiner* — Bryan Evans
(74) *Attorney, Agent, or Firm* — Dickinson Wright PLLC

(57) ABSTRACT

A skate shield for use with ice skates. The skate shield includes a rigid shell made at least of outer and inner layers of fiber reinforced plastic or polymer (FRP), and a fastener assembly for releasably securing the shell to a boot portion of the ice skate. The shell includes a medial side portion interconnected to a lateral side section via a top portion. A reinforced section formed by reinforcing layers laminated between the outer and inner layers is provided in at least one of the medial side portion and the lateral side portion of the shell.

17 Claims, 15 Drawing Sheets

(56) References Cited

U.S. PATENT DOCUMENTS

| | | | |
|---|---|---|---|
| 7,523,567 | B1 | 4/2009 | McClelland |
| 8,109,013 | B2 | 2/2012 | Parrott |
| 2003/0196351 | A1 | 10/2003 | Hipp et al. |
| 2011/0016617 | A1 | 1/2011 | Shrewsburg |
| 2012/0025478 | A1 | 2/2012 | Van Horne et al. |
| 2012/0204452 | A1 | 8/2012 | Van Horne et al. |

* cited by examiner

FIG. 10
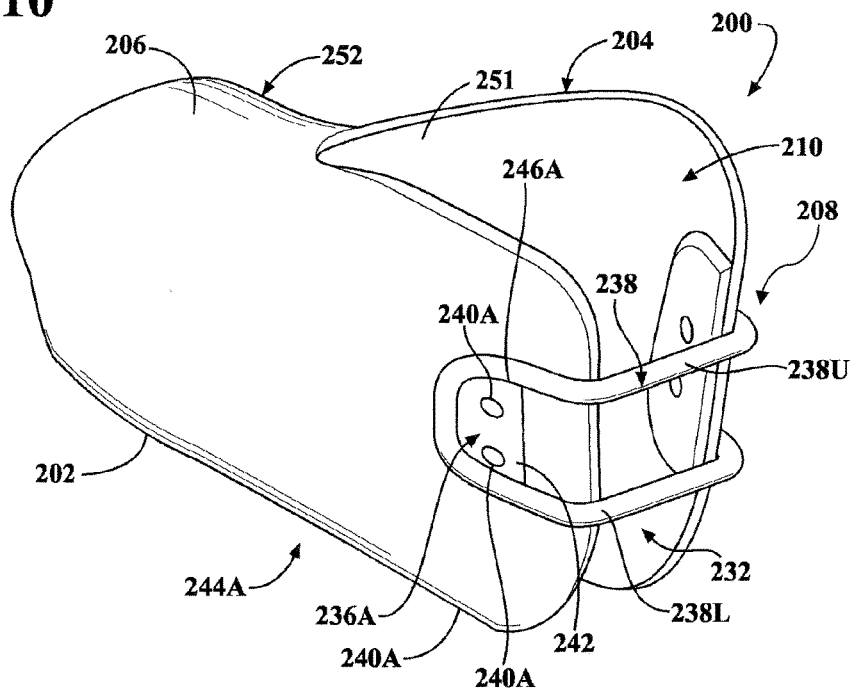
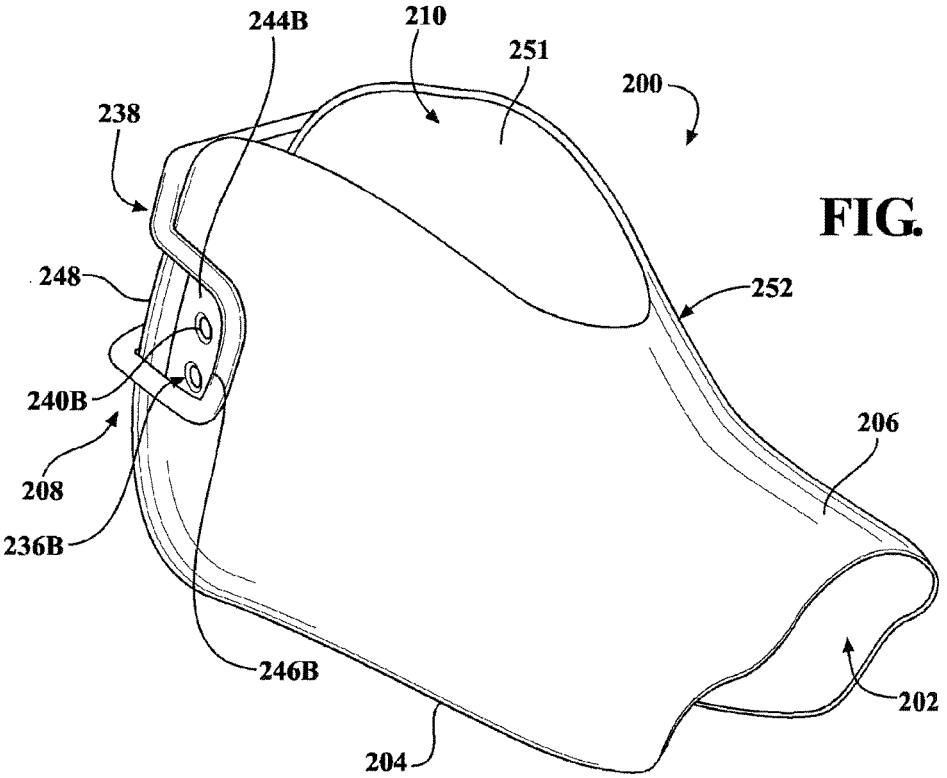
FIG. 11

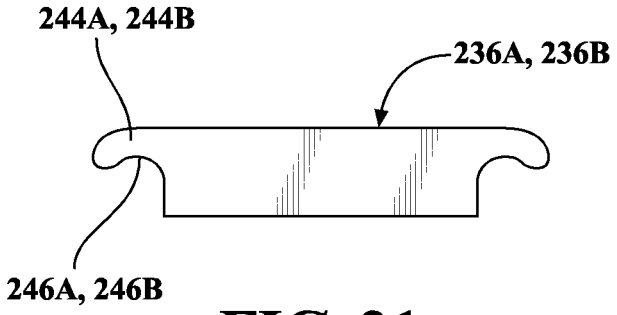
FIG. 21
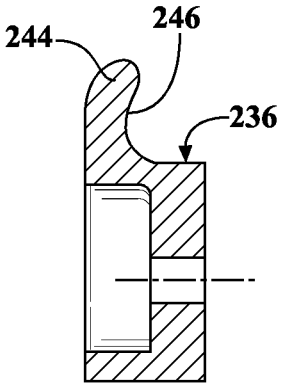
FIG. 22
FIG. 23
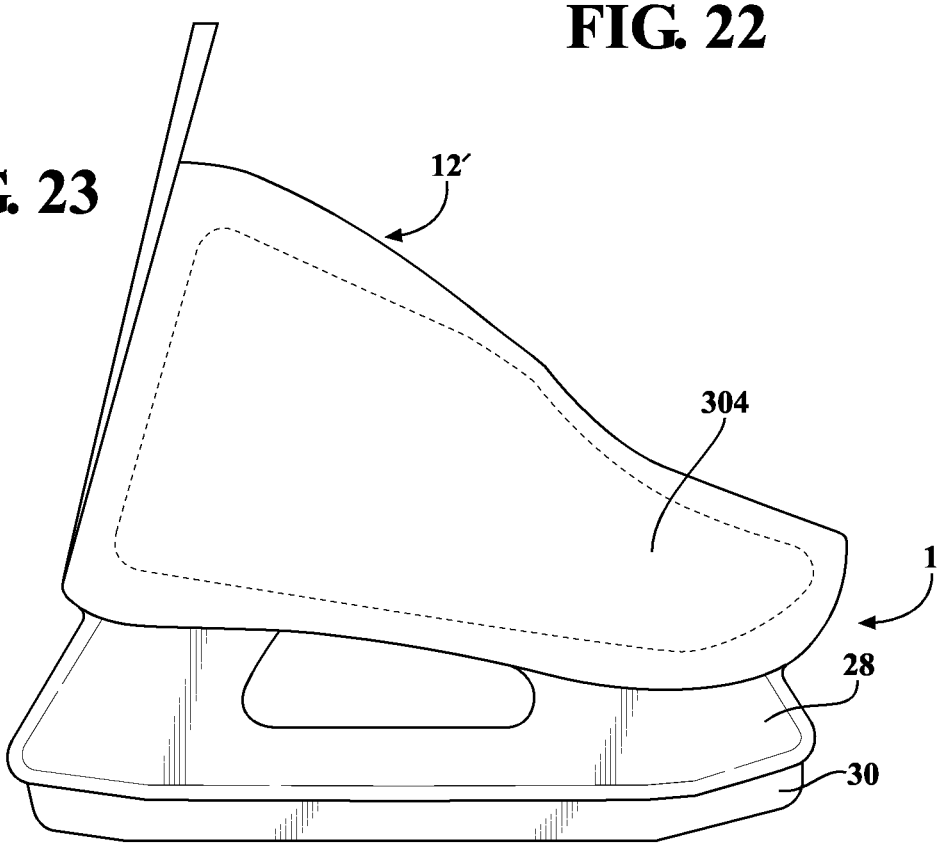

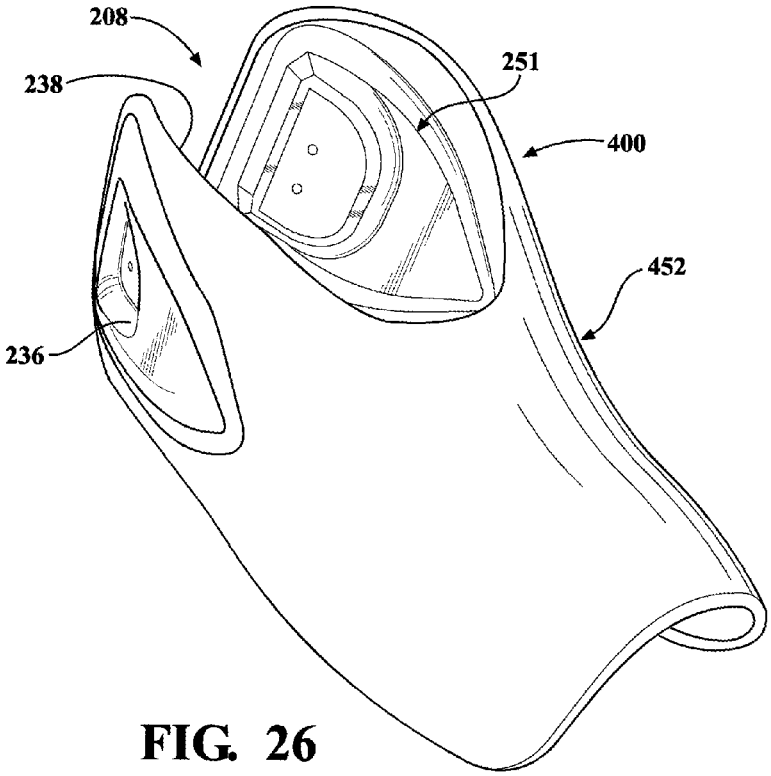
FIG. 26
FIG. 28
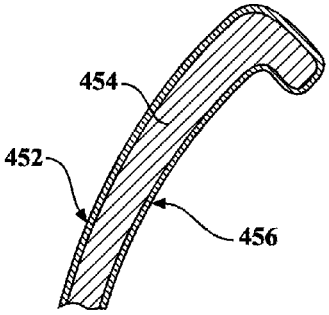
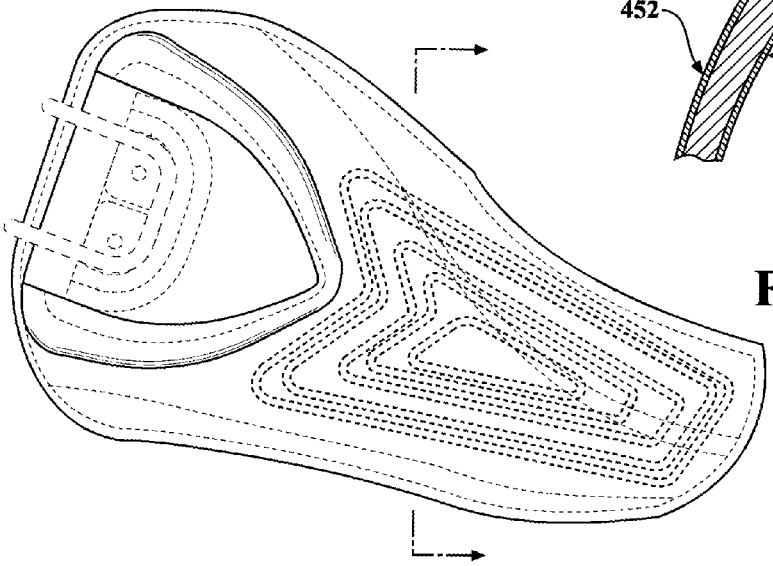
FIG. 27

HOCKEY SKATE SHIELD

CROSS-REFERENCE TO RELATED APPLICATIONS

This application claims priority to and the benefit of U.S. Provisional Application No. 61/858,242 filed Jul. 25, 2013 and U.S. Provisional Application No. 61/888,262 filed Oct. 8, 2013. The entire disclosure of the above applications is incorporated herein by reference.

FIELD

The present disclosure relates generally to protective devices for skates and, more particularly, to a removable skate shield that is mountable to a boot portion of an ice skate.

BACKGROUND

This section provides background information related to the present disclosure which is not necessarily prior art.

Due to the nature of the game, ice hockey injuries are common and range from annoying aches and pains to more serious traumas. Statistics indicate that a large majority of ice hockey injuries are caused by direct trauma during games. Hard body checks, player collisions with each other and the sideboards or ice, and direct blows from the puck, flying sticks and skates are the most common cause of such injuries. To this end, hockey players wear safety equipment such as helmets, pads and protective gear to avoid or reduce the risk of injury.

Skate protectors are used by hockey players in an effort to reduce the occurrence of foot injuries due to impact forces applied to their skates. Typically, skate protectors include multi-piece assemblies that are tied-on or strapped to the ice skates. Due to the excessive time required to install and remove conventional skate protectors, use of such protective devices has met with only minimal success. Examples of known skate protectors are disclosed in U.S. Pat. No. 2,029,787 to Ohler; U.S. Pat. No. 3,806,145 to Czeiszperger; U.S. Pat. No. 5,234,230 to Crane; U.S. Pat. No. 5,829,170 to Lutz; U.S. Pat. No. 6,854,200 to Hipp; U.S. Pat. No. 7,021,663 to Moran; U.S. Pat. No. 7,253,567 to McClelland; and U.S. Pat. No. 8,109,013 to Parrott.

In view of the shortcomings associated with such conventional skate protectors, a need exists to develop improved protective devices that provide enhanced foot protection and simplified use.

SUMMARY

This section provides a general summary of the disclosure and is not a comprehensive disclosure of its full scope or all of its features.

It is an aspect of the present disclosure to provide a skate shield that addresses and overcomes the shortcomings of conventional skate protectors.

It is another aspect of the present disclosure to provide a skate shield having a shell made from a fiber reinforced polymer or plastic (FRP) material capable of providing enhanced stiffness while functioning to distribute impact forces over a larger area of the foot.

It is another aspect of the present disclosure to provide a skate shield that can be easily and quickly installed and removed from ice skates.

These and other aspects are provided by a skate shield constructed in accordance with the teachings of the present disclosure. Specifically, the skate shield includes a shell fabricated from a fiber reinforced material and configured to include a medial side portion and a lateral side portion interconnected by a top portion. A toe aperture formed in a front end of the top portion surrounds a toe portion of the ice skate, an ankle aperture formed between the medial and lateral side portions and a back end of the top portion surrounds an ankle portion of the ice skate, and a heel aperture communicating with the ankle aperture surrounds a heel portion of the ice skate. The skate shield further includes a fastener assembly adapted to releasably interconnect the medial side portion and the lateral side portion across the heel aperture for removably securing the shell to the ice skate.

The fastener assembly associated with the skate shield of the present disclosure may include a strap having a first end portion rigidly affixed to one of the medial and lateral side portions of the shell. A second end portion of the strap may be releasably secured to a fastener associated with the other one of the medial and lateral side portions of the shell. The fastener may include a hook and loop arrangement (VELCRO) a snap arrangement, or any other fastening arrangement configured to permit releasable attachment of the skate shield to the ice skate.

The fastener assembly associated with the skate shield of the present disclosure may alternatively include a pair of clip retainers rigidly affixed to each of the medial and lateral side portions of the shell and a resilient ring or strap that can be releasably secured to the clip retainers. The resilient ring can be configured as an O-ring sized to engage each of the clip retainers and permit releasable attachment of the skate shield to the ice skate.

The skate shield of the present disclosure further includes reinforced sections formed in at least one of the medial side portion, the lateral side portion and the top portion to provide additional shell thickness and rigidity. The reinforced sections include one or more reinforced sections which, in turn, each include one or more reinforcing layers laminated between an outer layer and an inner layer of the shell.

In accordance with another aspect of the present disclosure, a boot assembly of an ice skate is reinforced with one or more layers of a fiber reinforced material, oriented optimally to produce a stiff boot structure configured to protect critical areas of the foot. The reinforced boot assembly includes a rigid outer shell, a resilient/deformable inner shell, and one or more layers of reinforcing material between the outer shell and inner shell. In this way, the reinforcement layers or "patches" can be integrated directly into the ice skate to provide an option to the ice skate and shield assembly of the present disclosure.

Further areas of applicability will become apparent from the description provided herein. The description and specific examples in this summary are intended for purposes of illustration only and are not intended to limit the scope of the present disclosure.

DRAWINGS

The drawings described herein are provided for the purpose of illustrating selected embodiments and are not intended to limit the scope of the present disclosure. In this regard, a detailed description of selected exemplary embodiments is provided herein with reference to the accompanying drawings.

FIGS. 10 and 11 are side perspective views of the skate shield constructed in accordance with a second embodiment of the present disclosure;

FIG. 15A is a sectional view taken generally along line 15-15 of FIG. 14 illustrating reinforced sections of the rigid shell associated with the skate shield of FIGS. 10 and 11, while

FIGS. 19, 20 and 21 are perspective, top and side views, respectively, of the clip retainers associated with the fastener assembly shown in the skate shield of FIGS. 10 and 11;

FIG. 22 is a sectional view taken generally along lines 22-22 of FIG. 20;

FIGS. 23 through 25 illustrate an ice skate having a boot section incorporating layers of reinforced materials to provide enhanced stiffness in accordance with the teachings of the present invention;

FIGS. 26 through 28 illustrate perspective, side and section views, respectively, of a skate shield constructed in accordance with another embodiment of the present disclosure.

Corresponding reference numerals indicate corresponding parts, components and/or assemblies throughout the several views of the drawings.

DETAILED DESCRIPTION

Example embodiments will now be more fully described with reference to the accompanying drawings. These example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

In general, the present disclosure is directed to a skate shield that can be removably attached to a hockey skate for providing additional protection against foot and ankle injuries. As will be detailed with greater specificity, the skate shield of the present disclosure is preferably fabricated from a fiber-reinforced polymer or plastic (FRP) or thermoplastic (FRTP), such as a carbon-fiber cloth material, to provide a rigid, yet lightweight, protective device capable of use with virtually any type of conventional ice skate, roller skate or in-line roller skate.

Figure 1:
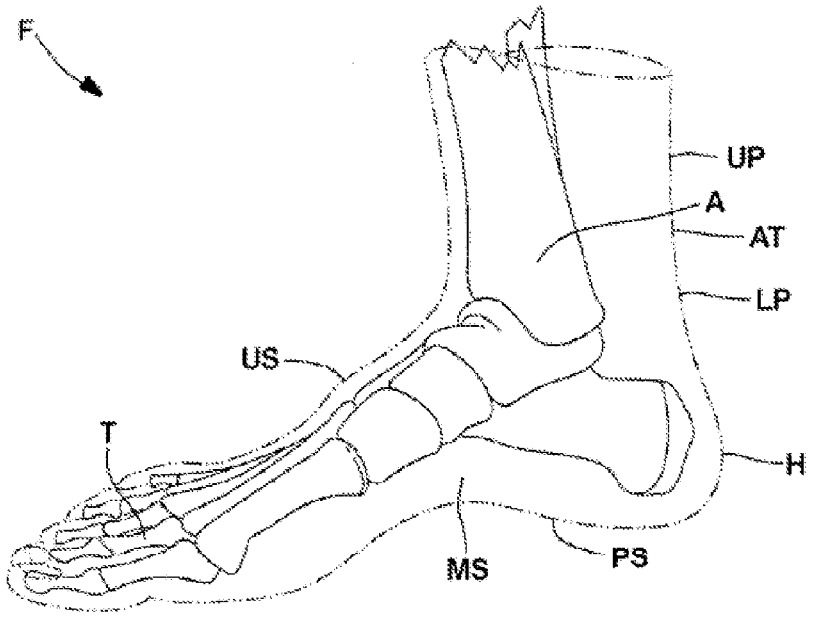
FIG. 1 is a side view of a right human foot with an outline of the foot shown in dashed lines and the bones shown in solid lines.
Figure 2:
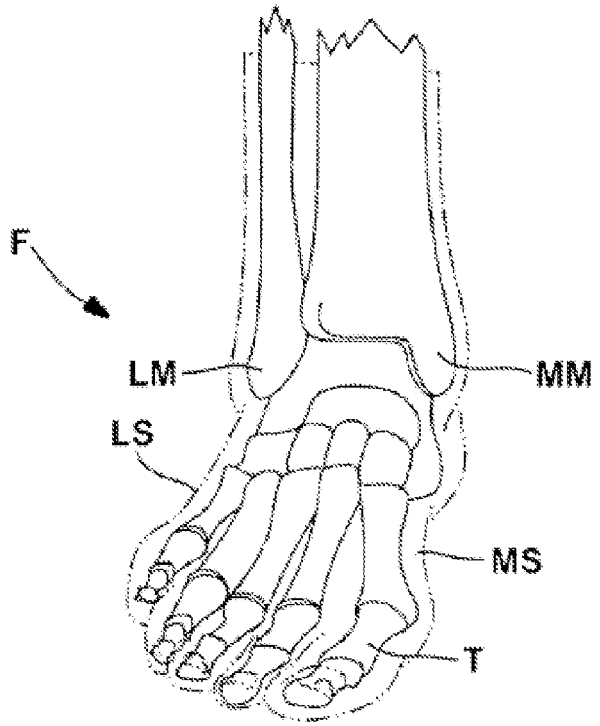
FIG. 2 is a front view of the right human foot shown in FIG. 1.

As noted, the present disclosure relates to skate shields for use in cooperation with skates, particularly ice hockey skates, for providing additional protection to the foot and ankle of a skater. To better define the areas afforded additional protection, FIGS. 1 and 2 illustrate a typical human right foot (F). The foot includes toes (T), a plantar surface (PS), an upper surface (US), a medial side (MS) and a lateral side (LS). In addition, the human foot includes a heel (H), an Achilles tendon (AT) and an ankle (A) having a lateral malleolus (LM) and a medial malleolus (MM). The Achilles tendon (AT) has an upper portion (UP) and a lower portion (LP) projecting outwardly with relation to the upper part and merging with the heel.

Figure 3:
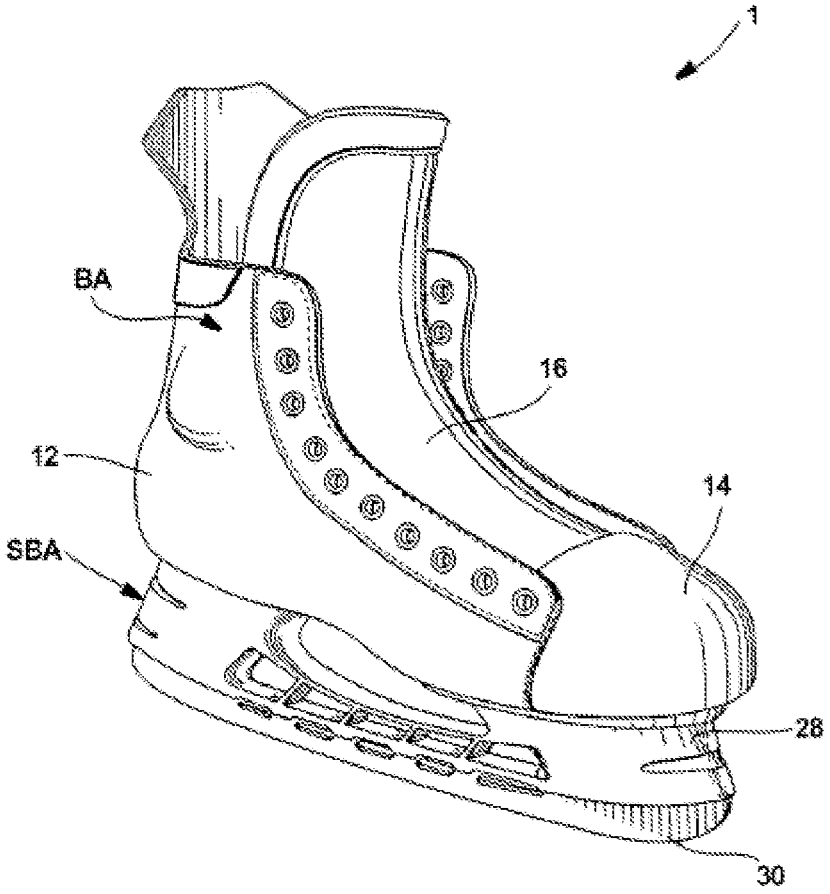
FIG. 3 is a perspective view of an exemplary ice skate configured for mounting on the right human foot shown in FIGS. 1 and 2 and which is adapted for use with a skate shield constructed in accordance with the teachings of the present disclosure.
Figure 4:
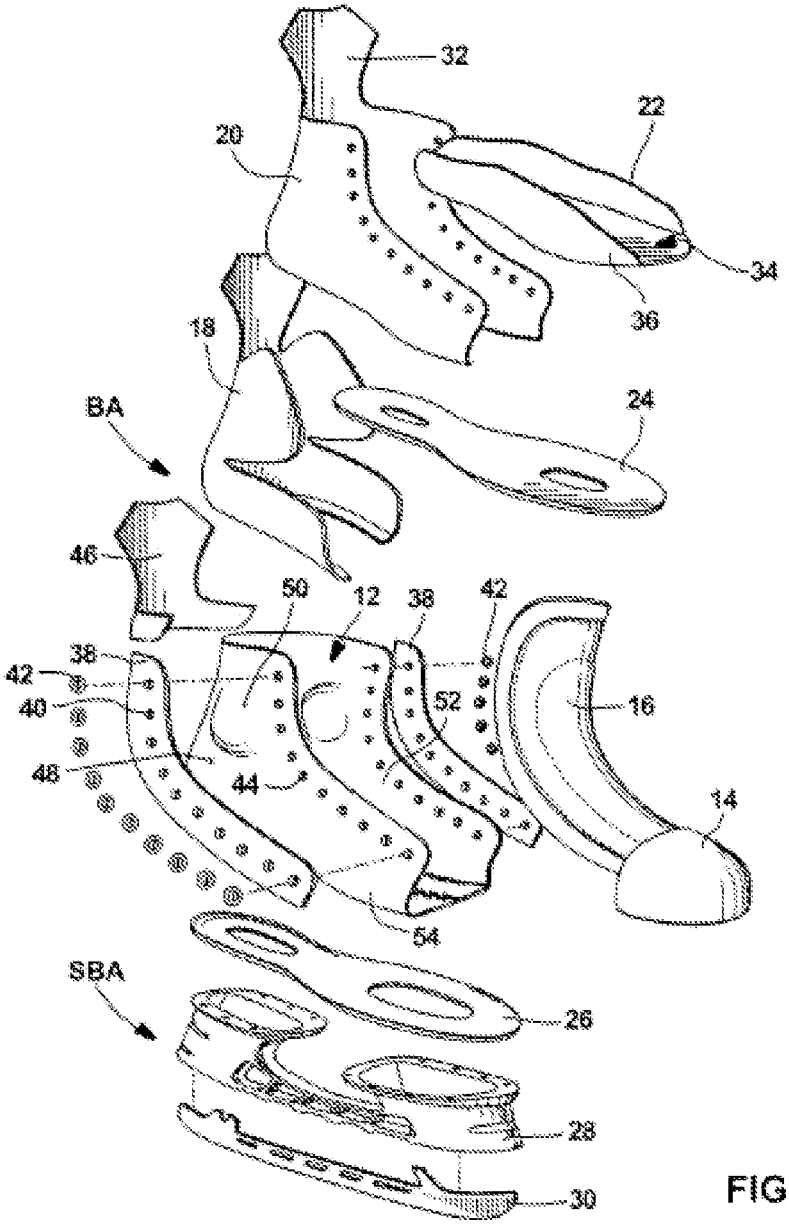
FIG. 4 is an exploded perspective view of the exemplary ice skate shown in FIG. 3.
Figure 5:
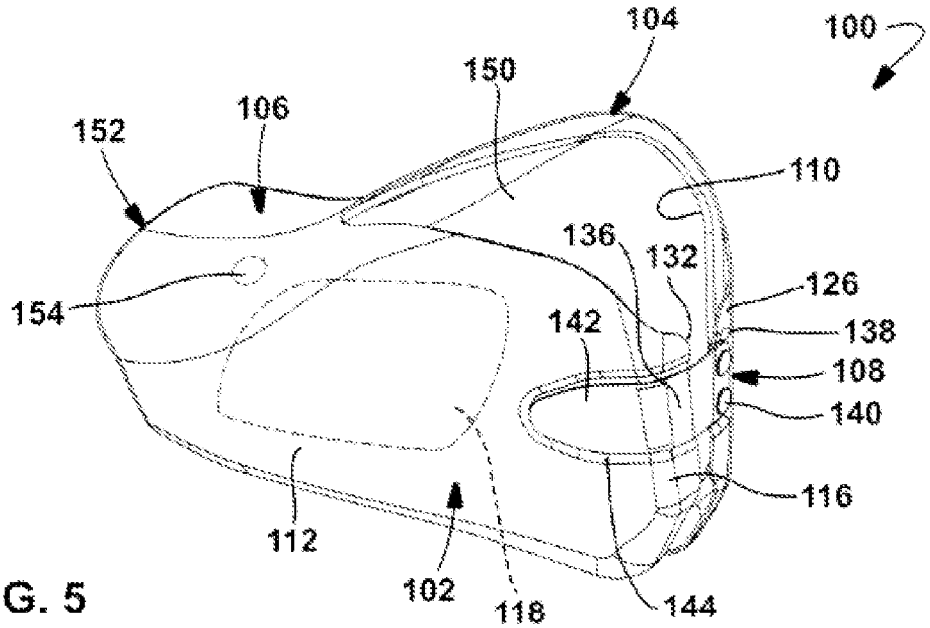
FIGS. 5 and 6 are side perspective views of a skate shield constructed in accordance with a first embodiment of the present disclosure.
Figure 6:
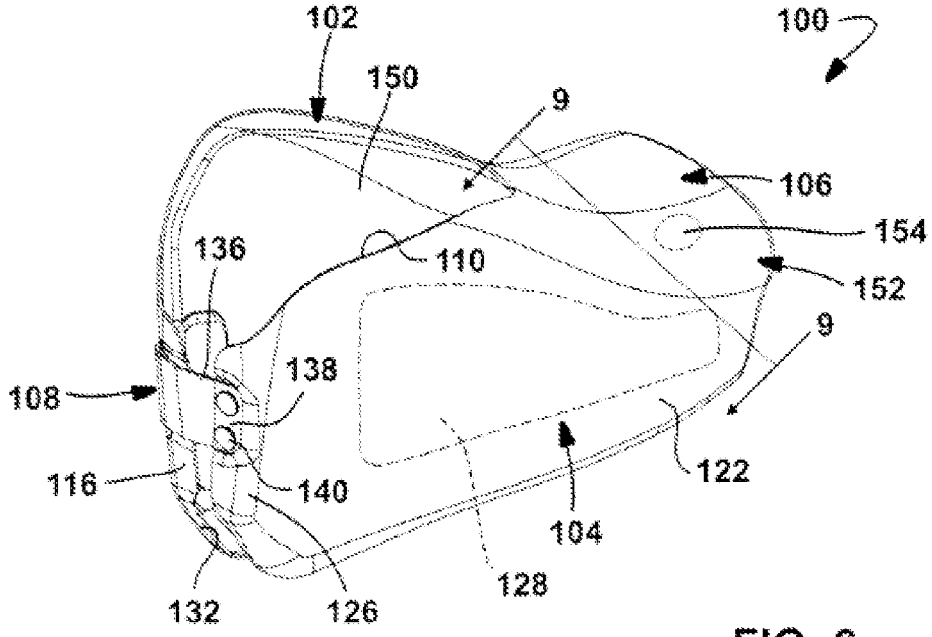
Figure 7:
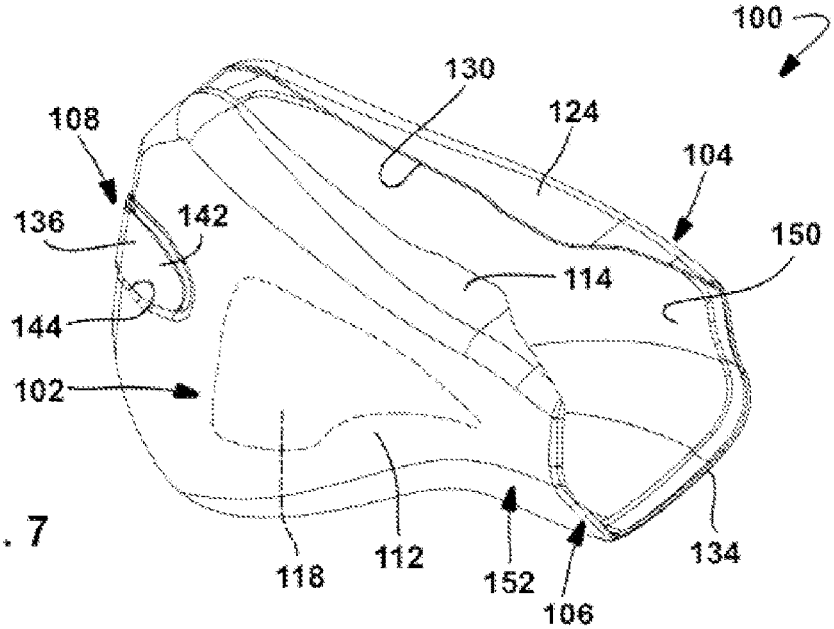
FIGS. 7 and 8 are bottom perspective views of a skate shield shown in FIGS. 5 and 6.
Figure 8:
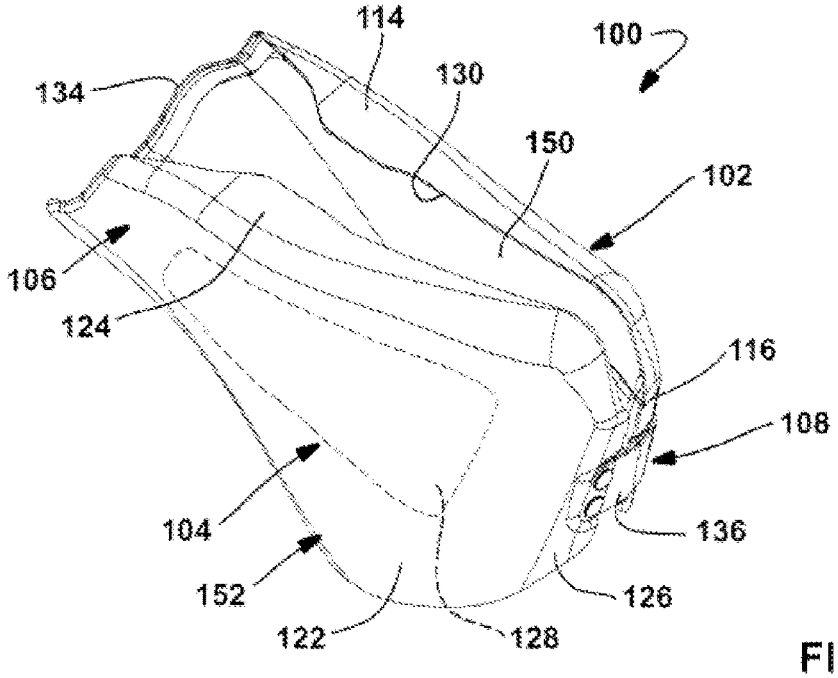

Referring now to FIGS. 3 and 4, an exemplary ice skate 1 is shown which is suitable for use with foot (F). Ice skate 1 generally includes a boot assembly (BA) and a skate blade assembly (SBA). The boot assembly is shown to include a rigid outer shell 12 for receiving foot (F), a rigid toe cap 14 facing toes (T), a tongue 16 extending upwardly and rearwardly from toe cap 14 for covering upper surface (US) of foot (F), a rigid ankle and heel insert 18, an inner liner 20, a footbed 22, an insole plate 24, and a rigid outsole plate 26. The skate blade assembly is adapted to be secured to outsole plate 26 of the boot assembly and includes a blade holder 28 and a blade 30.

Inner liner 20 is secured to an inner surface of outer shell 12 and has an elongated tab 32. Inner liner 20 is configured to contact several portions of foot (F) including heel (H), ankle (A), medial side (MS) and lateral side (LS). Footbed 22 is also mounted inside outer shell 12 and includes a surface 34 configured to receive the plantar surface (PS) and a pair of side surfaces 36 partially surrounding the sides of foot (F).

The boot assembly (BA) further includes a pair of bands 38 secured to side portions of outer shell 12. Bands 38 include apertures 40 which receive eyelets 42 that also extend through apertures 44 formed in outer shell 12. A tendon guard 46 is also affixed to outer shell 12 to overlay tab 32 of inner liner 20 and is configured to face at least a portion of upper portion (UP) of Achilles tendon (AT). Outer shell 12 is configured to include an enclosed heel portion 48 for receiving heel (H), an ankle portion 50 for receiving ankle (A), and medial and lateral side portions 52, 54 for facing the medial and lateral sides (MS, LS), respectively.

Referring now to FIGS. 5 through 9, a protective device, hereinafter referred to as a skate shield 100, is shown constructed in accordance with a first embodiment of the present disclosure and configured to be releasably attached to the boot assembly (BA) of ice skate 1. Specifically, a 'right' skate shield 100 is illustrated for use with the right ice skate, but those skilled in the art will recognize that a 'left' skate shield would also be provided for use with a left ice skate. The left skate shield would have a symmetric or mirror-image construction in comparison to right skate shield 100 shown in the drawings. The right and left skate shields would be offered as a pair of skate shields configured and sized to permit removable attachment to a pair of ice skates.

Skate shield 100 is shown to generally include a rigid shell 152 having a medial side portion 102 and a lateral side portion 104 interconnected by a top portion 106. Skate shield 100 also includes a strap-type fastener assembly 108 for releasably securing rigid shell 152 on the boot assembly (BA) of ice skate 1. Medial side portion 102, lateral side portion 104 and top portion 106 cooperate to define an ankle opening 110 configured to generally surround ankle portion 50 of outer shell 12.

Medial side portion 102 is shown to include a medial side section 112, a bottom flange section 114 extending transversely from medial side section 112, and a heel flange 116 extending transversely from medial side section 112. Preferably, bottom flange section 114 and heel flange section 116 define a continuous flange adapted to engage corresponding medial portions of the boot assembly (BA). Specifically, bottom flange section 114 is configured to surround and overlay a medial portion of outsole plate 26 while heel flange section 116 is configured to surround and overlay a medial part of heel portion 48 of outer shell 12. In addition, medial side section 112 includes at least one reinforced section 118 (shown in phantom) which is shown, for example, to be configured to be aligned with and overlay ankle portion 50 and medial side portion 52 of outer shell 12.

Lateral side portion 104 is shown to include a lateral side section 122, a bottom flange section 124 extending transversely from lateral side section 122, and a heel flange section 126 extending transversely from lateral side section 122. Preferably, bottom flange section 124 and heel flange section 126 define a continuous flange adapted to engage corresponding lateral portions of the boot assembly. Specifically, bottom flange section 124 is configured to surround and overlay a lateral portion of outsole plate 26 while heel flange section 126 is configured to surround and overlay a lateral part of heel portion 48 of outer shell 12. In addition, lateral side section 122 includes at least one reinforced section 128 (shown in phantom) which is shown, for example, to be configured to aligned with and overlay lateral side portion 54 of outer shell 12.

Bottom flange sections 114 and 124 are generally aligned to extend along a common plane and are separated by an elongated bottom aperture 130 formed therebetween. Heel flange sections 116 and 126 are likewise generally aligned to extend along a common plane and are separated by a heel aperture 132. Heel aperture 132 communicates with bottom aperture 130 which, in turn, communicates with a toe aperture 134 formed in an open-end of top portion 106 of skate shield 100. Strap assembly 108 includes a strap 136 fixedly secured at a first end 138 (i.e. via rivets 140 or other suitable 'fixed' fasteners) to heel flange section 126 of lateral side portion 104. A second end 142 of strap 136 is releasably attachable (i.e. via snaps, Velcro or other suitable "releasable" fasteners) to heel flange section 116 and/or side section 112 of medial side portion 106. A recess 144 is formed in heel section 116 and side section 112 to retain second end 142 of strap 136 thereon. Obviously, the orientation of strap assembly 106 relative to the medial and lateral side portions of skate shield 100 can be reversed. When second end 142 of strap 136 is released from engagement, skate shield 100 may be easily slide on or off of ice skate 1. In contrast, when second end 142 of strap 136 is secured, skate shield 100 is mounted on ice skate 1.

A layer of an energy absorbing resilient material 150 is secured to the inner surface of medial side portion 102, lateral side portion 104 and top portion 106 to dampen the impact forces transferred from skate shield 100 to ice skate 1. Non-limiting examples of energy absorbing resilient material may include a layer of neoprene or foam that is bonded to the inside surfaces of skate shield 100 and which has a thickness in the range of 2-10 mm. The resilient layer of material 150 may be bonded as a single piece, such as to define an inner liner 151, or as separate pieces each bonded to corresponding portions of skate shield 100. The resilient layer 150 also functions to reduce damage to ice skate 1 due to contact with rigid skate shield 100. Additionally, resilient layer 150 provides a "gripping" function to maintain contact with the boot assembly (BA) of ice skate 1 and inhibit sliding movement between skate shield 100 and ice skate 1. Resilient layer 150 also provides a gripping surface for use by the user when installing skate shield 100 on ice skate 1.

In accordance with the present disclosure, a rigid shell 152 of skate shield 100 is defined by the combination of medial portion 102, lateral portion 104 and top portion 106. Shell 152 is preferably fabricated from a fiber reinforced polymer or plastic (FRP) or thermoplastic (FRTP) to provide a rigid, high-stiffness, component adapted to disburse impact forces prior to transmission of the impact forces to ice skate 1. More preferably, shell 152 is constructed from multiple layers of carbon fiber cloth that are bonded with a suitable resin to define a carbon fiber reinforced (CFR) component. Medial side portion 102, lateral side portion 104 and top portion 106 each include an outer layer 160 of carbon fiber cloth laminated to an inner layer 162 of carbon fiber cloth. Outer layer 160 can be made from, for example, a carbon fiber 12K 19 oz. 0.6 mm 2×2 twill cloth. Likewise, inner layer 162 can be made from, for example, a carbon fiber 12K 19 oz. 0.6 mm 2×2 twill cloth.

Figure 9:
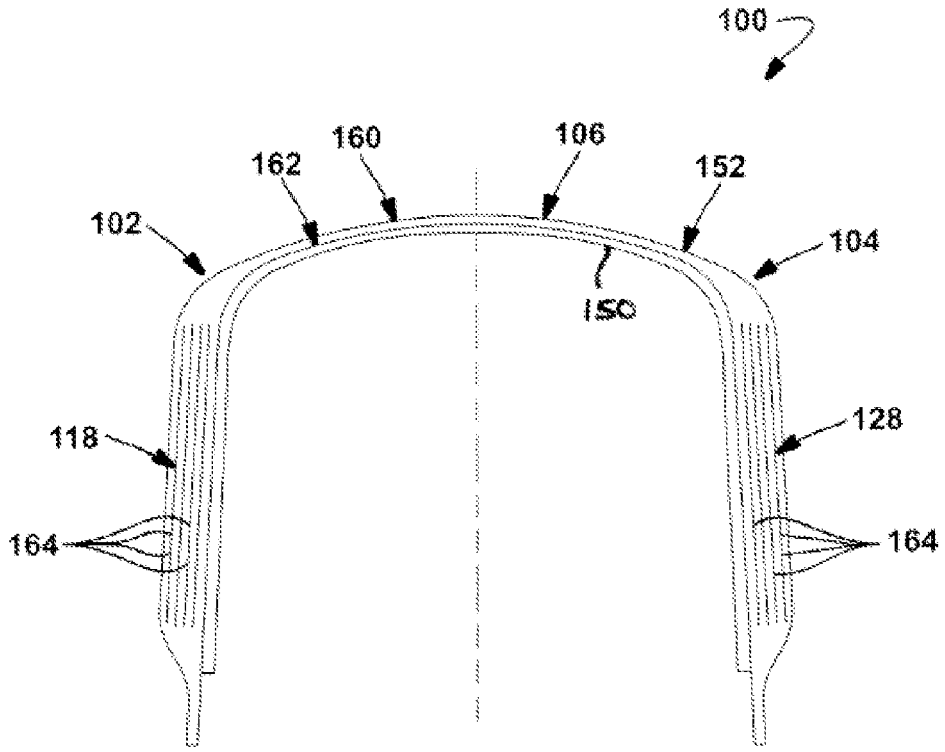
FIG. 9 is a vertical sectional view taken through a portion of the skate shield shown in FIGS. 5 through 8 and generally indicated by line 9-9 of FIG. 6.
Figure 12:
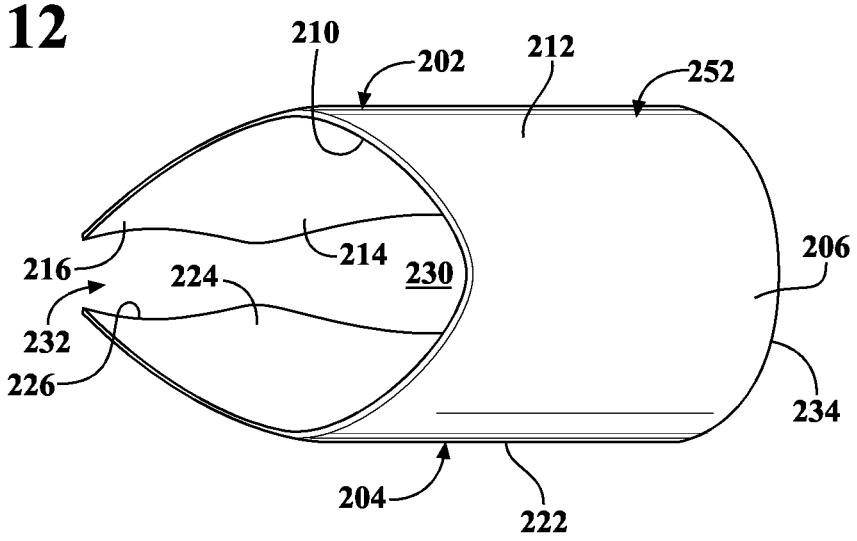
FIGS. 12 and 13 are top and bottom perspective view of the rigid shell associated with the skate shield shown in FIGS. 10 and 11.
Figure 13:
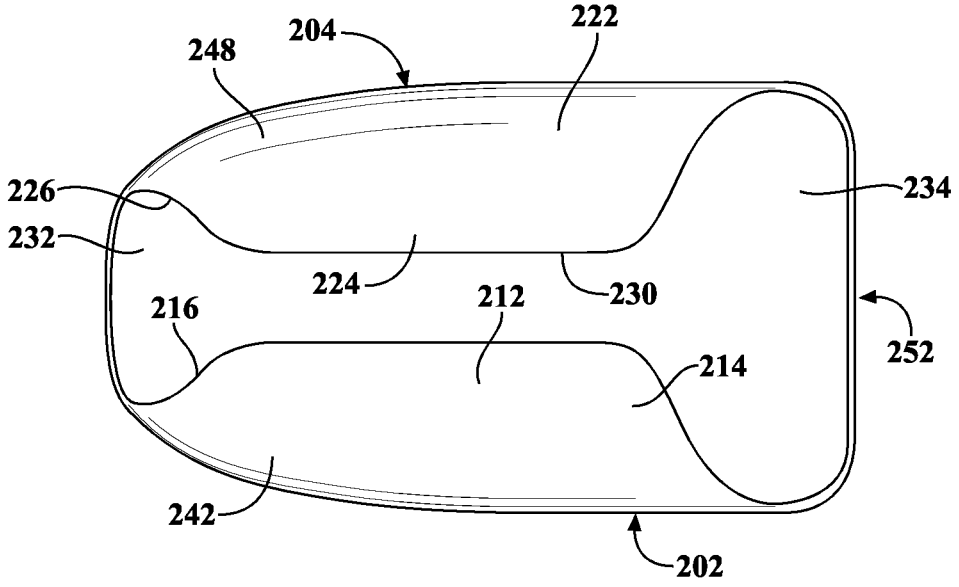
Figure 14:
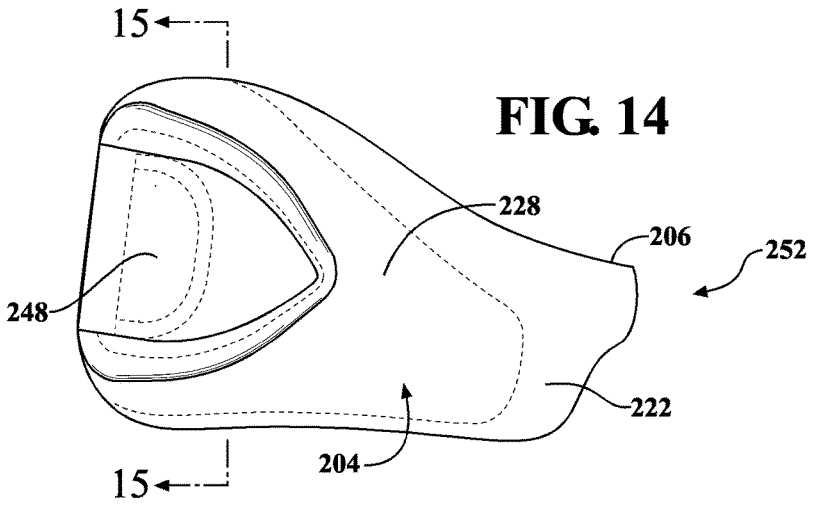
FIG. 14 is a side view of the rigid shell shown in FIGS. 12 and 13 illustrating the location of reinforcing back plates integrated into the medial and lateral side portions of the rigid shell.
Figure 15A:
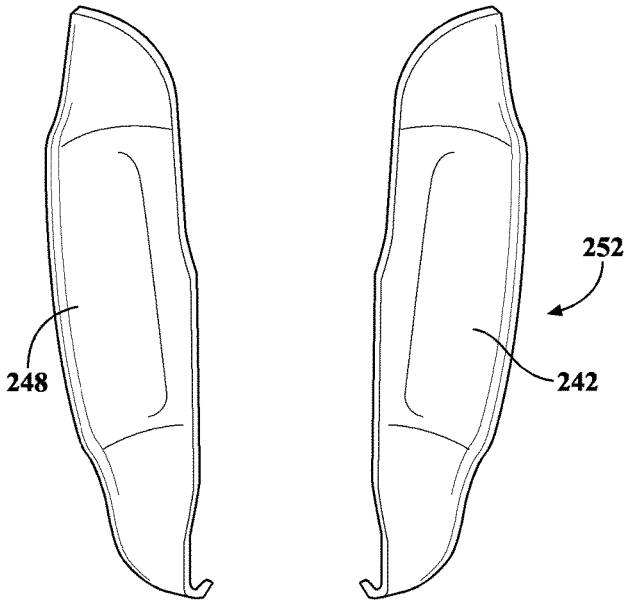
Figure 15B:
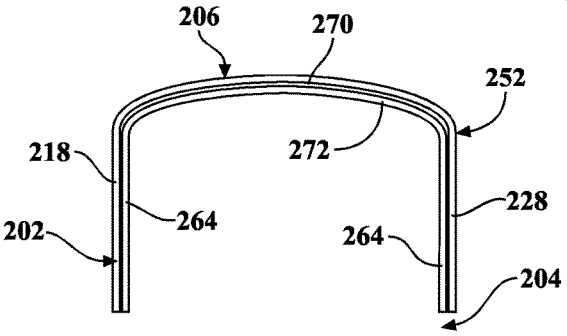
FIG. 15B is another vertical sectional view of the skate shield of the present disclosure.

As best seen from FIG. 9, reinforced sections 118 and 128 include additional layers, referred to as reinforced layers 164, of carbon fiber cloth laminated between outer layer 160 and inner layer 162. Reinforcement layers 164 can be made of the same material as the inner and outer layers (i.e. 12K 19 oz. 0.6 mm 2×2 twill carbon fiber cloth) or, in the alternative, made from any other suitable material providing additional impact resistance and/or damping characteristics. While four (4) reinforced layers 164 are shown in association with each of reinforced sections 118 and 128, it will be understood that the specific number will be dependent on the desired thickness. Likewise, a plurality of distinct reinforced sections can be formed in one or more of medial side portion 102, lateral side portion 104 and top portion 106, with each having a different number of reinforced layers 164 to vary the thickness and stiffness.

With shield 100 installed on ice skate 1, toe portion 14 extends through toe aperture 134 while its ankle portion extends through ankle aperture 110. In this manner, medial side portion 102 of shell 152 protects the medial side (MS) of the foot, lateral side portion 104 of shell 152 protects the lateral side (LS) of the foot, and top portion 106 of shell 152 protects upper surface (US) of the foot.

To mount skate shield 100 onto boot assembly (BA) of ice skate 1, the user twists one or both side portions 102, 104, generally upon gripping heel flange sections 116, 126, respectively. This twisting action creates sufficient enlargement of heel apertures 132 and ankle aperture 110 to permit shield 100 to slip over the boot assembly and past the user's ankle. Upon release of the twisted side portion(s), shield 100 returns to its original shape and strap assembly 108 is secured. One or more reduced thickness areas and/or holes, schematically and cumulatively shown in phantom by reference numeral 154, can be provided to assist in facilitating the twist movement of the side portions of skate shield 100. While alternative mounting techniques could be available, the high stiffness of the carbon fiber reinforced shell 152 tends to require use of this twisting type mounting technique. With shield 100 mounted on the boot assembly, bottom flange sections 114, 124 will engage outsole plate 26 and avoid interference with skate holder 28.

Referring now to FIGS. 10 and 11, a skate shield 200 is shown constructed in accordance with a second embodiment of the present disclosure and which is configured to be releasably attached to the boot assembly (BA) of ice skate 1. Skate shield 200 is adapted for use with the right ice skate, however, those skilled in the art will appreciate that a mirror-image of skate shield 200 would be provided for use with a left ice skate. As previously noted, left and right versions of skate shield 200 would be offered together as a matched pair of protective devices configured and sized to permit removable attachment to a pair of ice skates.

Skate shield 200 is generally shown in FIGS. 10 and 11 to include a rigid shell 252 having a medial side portion 202 and a lateral side portion 204 interconnected by a top portion 206. Skate shield 200 also includes a ring-type fastener assembly 208 for releasably securing rigid shell 252 on the boot assembly (BA) of ice skate 1. Medial side portion 202, lateral side portion 204, and top portion 206 of shell 252 cooperate to define an ankle opening 210 configured to generally surround ankle portion 50 of outer shell 12 of ice skate 1.

Figure 16:
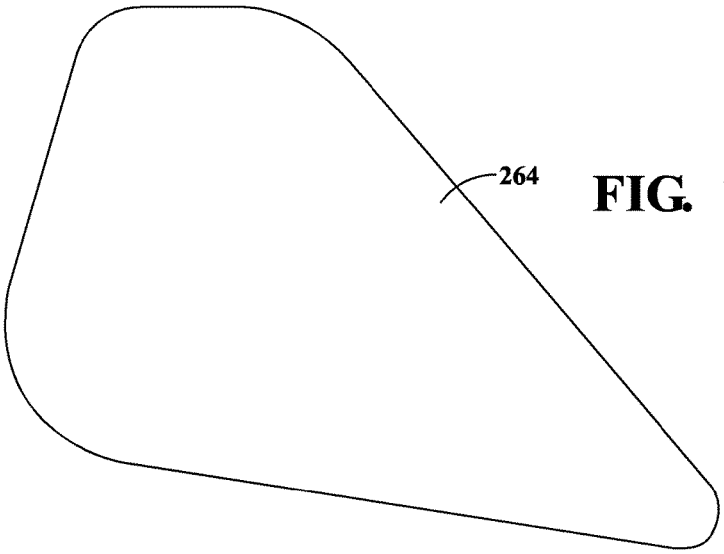
FIG. 16 illustrates the outer dimensions and configuration of a reinforcing back plate prior to molding.
Figure 17A:
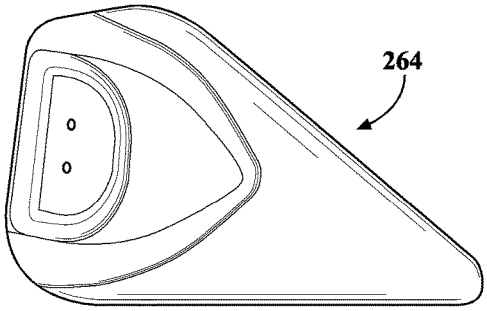
FIGS. 17A through 17D show various rotated positions of a molded reinforcing back plate associated with the skate shield of FIGS. 10 and 11.
Figure 17B:
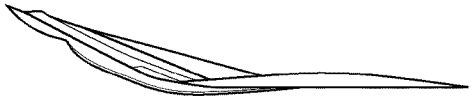
Figure 17C:
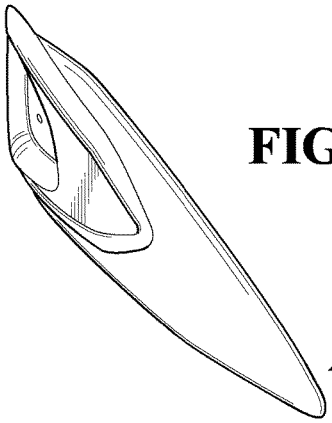
Figure 17D:
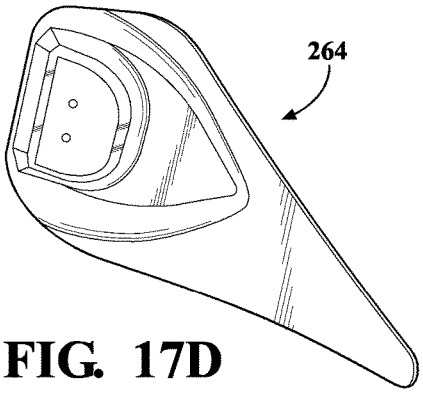

To provide detailed illustrations and descriptions of the components associated with skate shield 200, FIGS. 12-15 illustrate features of rigid shell 252; FIGS. 16-17 illustrate reinforcing back plates 264 associated with reinforced sections 218 and 228 of rigid shell 252; FIGS. 18A-18D relate to an inner liner 251; and FIGS. 19-22 relate to components of ring-type fastener assembly 208. Common reference numerals are used throughout these drawings to identify common components and/or structural features.

Medial side portion 202 of rigid shell 252 is shown to include a medial side section 212, a bottom flange section 214 extending transversely from medial side section 212, and a heel flange section 216 extending transversely from medial side section 212. Bottom flange section 214 and heel flange section 216 define a continuous flange adapted to engage corresponding medial portions of the boot assembly (BA). Specifically, bottom flange section 214 is configured to surround and overlay a medial portion of outsole plate 26 while heel flange section 216 is configured to surround and overlay a medial part of heel portion 48 of outer shell 12. Additionally, medial side section 212 includes at least one reinforced section 218 which is shown, for example, to be configured to be aligned with and overlay medial side portion 52 and ankle portion 50 of outer shell 12. As will be detailed, reinforced sections 218 include a plurality of reinforcing back plates 264.

Lateral side portion 204 is shown to include a lateral side section 222, a bottom flange section 224 extending transversely from lateral side section 222, and a heel flange section 226 extending transversely from lateral side section 222. Bottom flange section 224 and heel flange section 226 define a continuous flange adapted to engage corresponding lateral portions of the boot assembly (BA). Specifically, bottom flange section 224 is configured to surround and overlay a lateral portion of outsole plate 26 while heel flange section 226 is configured to surround and overlay a lateral part of heel portion 48 of outer shell 12. Additionally, lateral side section 222 includes at least one reinforced section 228 which is shown, for example, to be configured to be aligned with and overlay lateral side portion 54 and the lateral ankle portion of outer shell 12.

Bottom flange sections 214 and 224 are generally aligned and are separated by an elongated bottom aperture 230 formed therebetween. Heel flange sections 216 and 226 are likewise generally aligned and are separated by a heel aperture 232. Heel aperture 232 communicates with bottom aperture 230 which, in turn, communicates with a toe aperture 234 formed in an open-end of top portion 206 of rigid shell 252. Referring primarily to FIGS. 10 and 11, ring-type fastener assembly 208 is shown to include a pair of retainer clips 236A and 236B secured to rigid shell 252 on opposite sides of heel aperture 232, and an O-ring 238 adapted to be looped over retainer clips 236A, 236B so as to define an upper ring segment 238U and a lower ring segment 238L extending across heel aperture 232. Specifically, retainer clip 236A is secured via rivets 240A in a recessed portion 242 formed in medial side section 212. Retainer clip 236A includes an arcuate guide flange 244A which, in cooperation with an outer surface of recessed portion 242, defines a first retention groove 246A within which a portion of O-ring 238 is seated. Likewise, retainer clip 236B is secured via rivets 240B in a recessed portion 248 formed in lateral side section 222. Retainer clip 236B includes an arcuate guide flange 244B which, in conjunction with an outer surface of recessed portion 248, defines a second retention groove 246B within which another portion of O-ring 238 is seated. While the arrangement illustrated permits complete release of O-ring 238 from both retainer clips 236A, 236B, one of the retainer clips may be slightly modified to permanently secure a portion of O-ring 238 within its corresponding retention groove, thereby only requiring release of O-ring 238 from the other retainer clip retention groove to facilitate removal of skate shield 200 from ice skate 1.

Figure 18A:
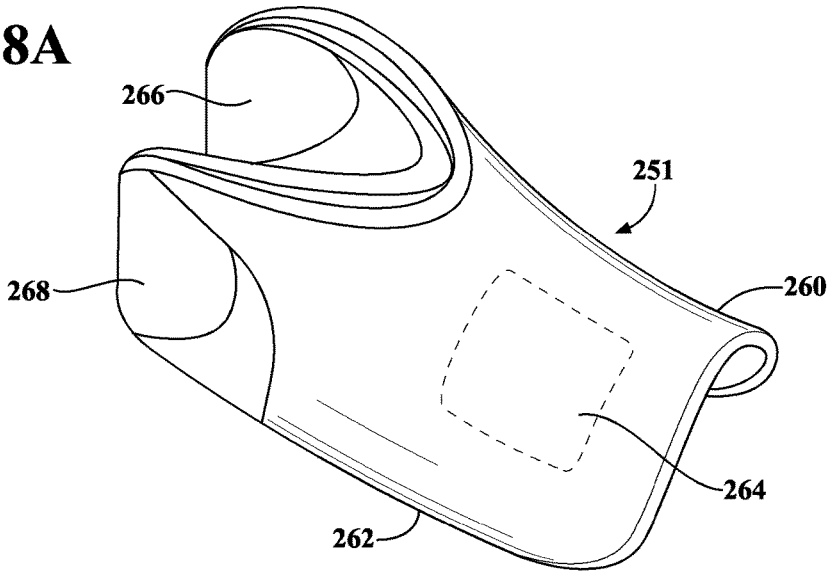
FIGS. 18A through 18D are various views of the resilient inner shell configured to be secured inside the rigid shell associated with the skate shield of FIGS. 10 and 11.
Figure 18B:
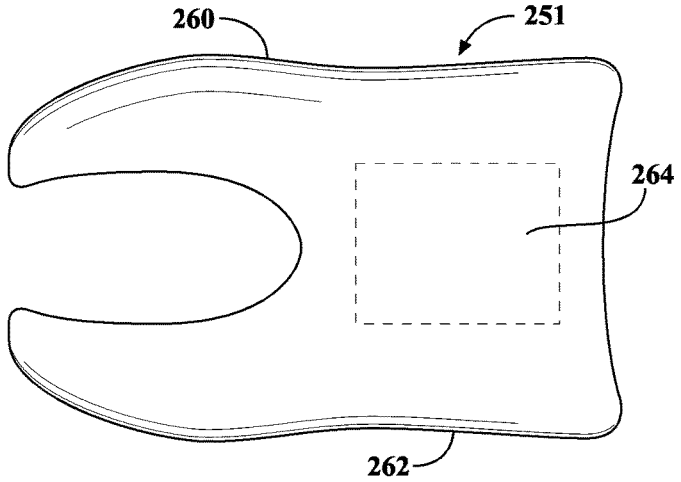
Figure 18C:
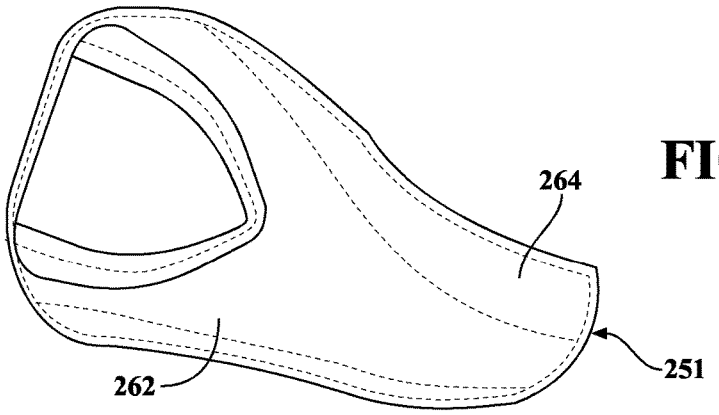
Figure 18D:
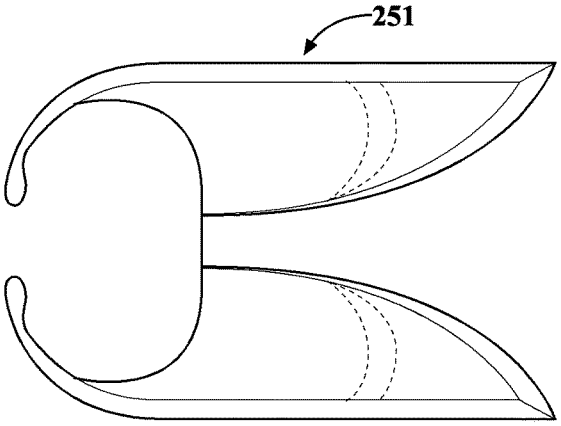
Figure 19:
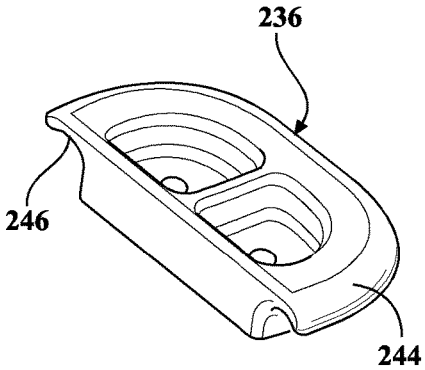
Figure 20:
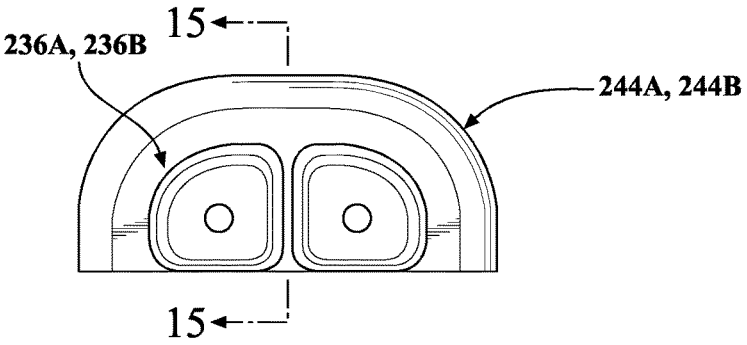

Inner liner 251 is made from an energy absorbing resilient material and is secured to the inner surfaces of medial side portion 202, lateral side portion 204 and top portion 206 of shell 252 to dampen the impact forces transferred from skate shield 200 to ice skate 1 and the foot of the wearer. Similarly to liner 151 of skate shield 100, liner 251 can be made of any suitable material which may include, without limitation, neoprene or foam and which preferably has a thickness in the range of 2-10 mm. As shown in FIGS. 18A-18C, inner liner 251 is prefabricated as a one-piece housing having a medial side portion 260, a lateral side portion 262 and a top portion 264 sized and configured to be bonded to corresponding inner surfaces of rigid shell 252. As seen, medial side portion 260 of liner 251 has an arcuate cut-out 266 configured to generally surround recessed portion 242 of medial side section 212 while lateral side portion 262 of liner 251 has a similar arcuate cut-out 268 configured to generally surround recessed portion 248 of lateral side section 222.

In accordance with the present disclosure, rigid shell 252 of skate shield 200 is fabricated from a fiber reinforced polymer or plastic (FRP) or thermoplastic (FRTP) to provide a rigid high-stiffness, impact-resistant component. More preferably, shell 252 is constructed from at least two layers of carbon fiber cloth that are bonded with a suitable resin to define a carbon fiber reinforced (CFR) component. Shell 252 includes an outer layer 270 and an inner layer 272 each made from, for example, carbon fiber 19 oz. 12K 0.6 mm thick 2×2 twill cloth.

FIGS. 10 and 11 show shell 252 to be configured to locate reinforced section 218 in medial side section 212 and reinforced section 228 in lateral side section 222. Reinforced section 218 includes an outwardly extending ankle projection 280 within which recessed portion 242 is located. Likewise, reinforced section 228 includes an outwardly extending ankle projection 282 within which recessed portion 248 is located. Pursuant to one preferred construction, a plurality of reinforcing back plates or reinforced patches 264 are laminated between outer layer 270 and inner layer 272 of shell 252 to define reinforced sections 218 and 228. FIG. 16 illustrates the general configuration of each reinforcement patch 264 prior to being formed into a finished back plate. To this end, FIGS. 17A-17D illustrate the "stackable" configuration of the finished back plate 264. Reinforcement patches 264 can be made of the same material as the inner and outer layers of shell 252 (i.e., 12K 19 oz. 0.6 mm thick 2×2 twill carbon fiber cloth) or any other material suitable to provide the requisite additional impact resistance and/or damping. While form (4) reinforcing back plates 264 are shown in association with each reinforcing section 218, 228, it will be understood that the particular number, size, material and location of such reinforcement patches can be varied as required with shell 252 to provide the required physical properties.

To mount skate shield 200 onto the boot assembly (BA) of ice skate 1, the user twists one or both side portions 202, 204 to expand heel aperture 232 and allow the ankle portion of boot 12 to extend into ankle aperture 210. Upon release, the deflected side portion(s) of shell 252 return to their original shape and ring-type fastener assembly 208 is thereafter secured.

While specific examples of skate shields 100, 200 have been disclosed with rigid shells fabricated from a least two layers of laminated carbon fiber reinforced material, it will be appreciated that other types of fiber reinforced material can likewise be used. These optional materials can include, for example, fiberglass and KEVLAR®. In addition, the weight, tow and weave of the fiber reinforced material can be selected to provide the requisite stiffness and manufacturability. Additionally, the matrix material used to bond the fiber reinforced layers can include any suitable polymeric resin, such as epoxy, to bind the cloth layers together. It is understood that any known method for laying and laminating the at least two layers may be used including hand laying, compression molding, and vacuum mold forming processes.

In summary, skate shields 100, 200 can be used by hockey players to reduce the occurrence of traumatic injury to the foot. Skate shields 100, 200 are constructed from at least two layers of a carbon fiber cloth bonded with a resin. Each layer is oriented to achieve maximum stiffness of shell 152, 252. This orientation may include parallel, orthogonal or any transverse alignment therebetween. The design of the rigid shell is configured to reduce the chance of a hockey stick getting caught between skate shield and ice skate 1. Weaker areas of the foot, or those prone to more severe trauma, may be reinforced with additional layers of reinforcing material.

Figure 24:
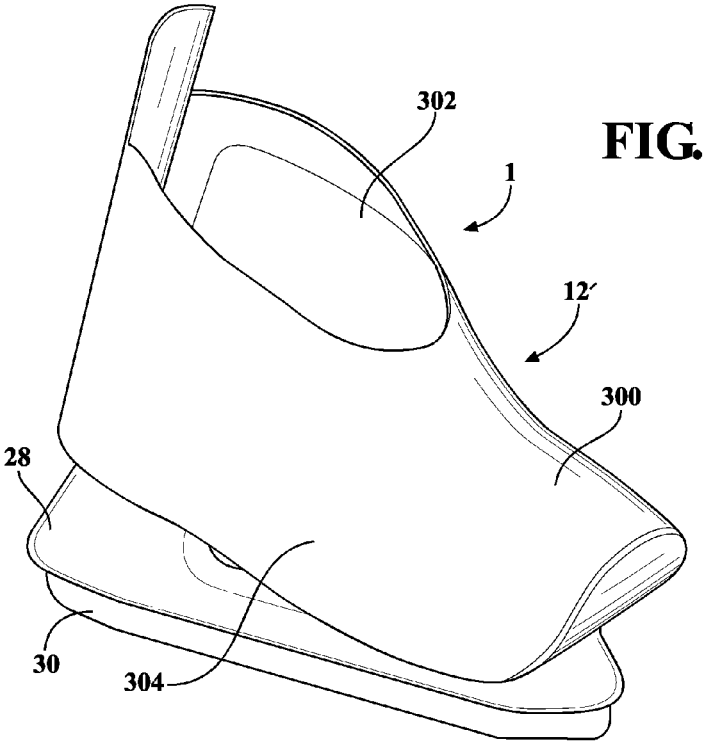
Figure 25:
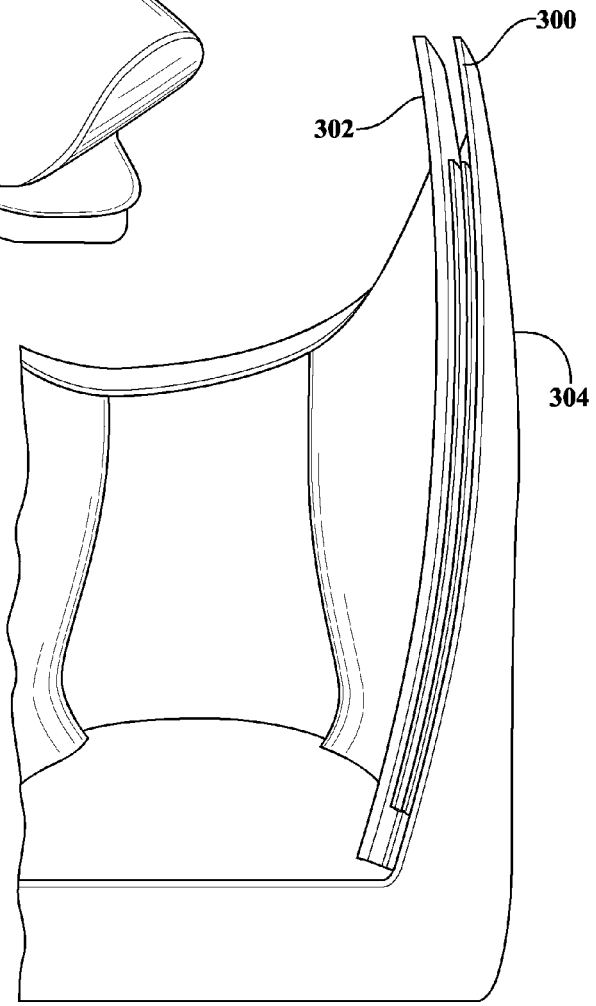

Referring now to FIGS. 23-25, a reinforced boot 12' for use with ice skate 1 is illustrated. Reinforced boot 12' integrates the teaching of using reinforced sections of the rigid shell of skate shields 100, 200 directly into the boot portion of the ice skate. In this regard, boot 12 (shown in FIGS. 3 and 4) can be replaced with reinforced boot 12' to provide additional rigidity and impact resistance. FIGS. 23-25 broadly illustrate such a reinforced boot 12' having one or more layers of a fiber reinforced material defining an outer shell 300, an inner liner 302, and a plurality of reinforcing patches 304 laminated therebetween. In addition to use of carbon-fiber reinforcement patches 304, other reinforcement material may include, for example and without limitation, Aluminum 7075-T6, ultra high strength steel SAEJ2430 1000DL or Titanium GRADE S-120000 psi yield Ti-6al-4v.

Those skilled in the art will recognize that the carbon-fiber reinforced rigid shells of the skate shields disclosed herein can be fabricated from other materials providing the requisite rigidity and impact resistance. In addition, the rigid shells can be coated with an outer structural coating. This confirmation is shown in FIGS. 26-28 wherein another embodiment of a skate shield 400 is shown to include a rigid shell 452, an inner liner 251 and ring-type fastener assembly 208. Rigid shell 452 is general similar in configuration and shape to rigid shell (FIGS. 10 and 11) except that shell 452 is a one-piece molded component 454 that has been coated with or encapsulated within an outer layer 456. The sectional view of FIG. 28 illustrates the general configuration of the base molded component 454 and outer layer 456. While certain preferred materials are disclosed for base component 454 and outer layer 456 of shell 452, any suitable materials are contemplated. Thus, skate shield 400 is also well-suited for use with ice skates 1.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A skate shield for use with an ice skate, comprising:

a shell fabricated from inner and rigid outer layers of a fiber reinforced material, said shell configured to include a medial side portion interconnected to a lateral side portion, wherein said medial side portion and said lateral side portion are interconnected by a top portion defining a toe aperture, said top portion of said shell cooperates with said medial and lateral side portions to define an ankle aperture, said medial and lateral side portions each configured to define a bottom flange section which cooperate to define a bottom aperture, said bottom aperture communicating with and configured to substantially perpendicular to each of said toe aperture and a heel aperture, and said heel aperture communicating with said ankle aperture;

said shell having at least one reinforced section laminated between said inner and outer layers; and a fastener assembly for releasably attaching said medial side portion to said lateral side portion for securing said skate shield to a boot portion of the ice skate.

2. The skate shield of claim 1 wherein the fastener assembly includes a strap having a first end portion rigidly affixed to one of said medial and lateral side portions of said shell, and wherein a second end portion of said strap is releasably secured to a fastener associated with the other one of said medial and lateral side portions of said shell.

3. The skate shield of claim 1 wherein said fastener assembly includes a pair of clip retainers rigidly affixed to each of said medial and lateral side portions of said shell and a resilient ring that can be releasably secured to said clip retainers.

4. The skate shield of claim 1 wherein said medial side portion is configured to define a medial side section a first heel flange section, wherein said lateral side portion is configured to define a lateral side section a second heel flange, wherein said bottom flange sections are spaced apart to define said bottom aperture therebetween, and wherein said first and second heel flanges are spaced apart to define said heel aperture.

5. The skate shield of claim 4 wherein a first reinforcement section is formed in said medial side section of said shell and a second reinforcement section is formed in said lateral side section of said shell, and wherein each of said first and second reinforcement sections include at least one reinforcing layer.

6. The skate shield of claim 5 wherein each one of said reinforcing layers is a preformed back plate laminated between said outer and inner layers of said shell.

7. The skate shield of claim 1 further comprising an inner liner of a resilient material bonded to an inwardly facing surface of said inner layer.

8. A skate shield for use with an ice skate, comprising:

a shell having an inner layer and a rigid outer layer of an impact resistant, fiber reinforced material, said shell configured to include a medial side portion interconnected to a lateral side portion, wherein said medial side portion and said lateral side portion are interconnected by top portion defining a toe aperture, said top portion cooperates with said medical and lateral side portions to define an ankle aperture, said medial and lateral side portions each configured to define a bottom flange section which cooperate to define a bottom aperture, said bottom aperture communicating with and configured to be substantially perpendicular to each of said toe aperture and a heel aperture, and said heel aperture communicating with said bottom aperture and said ankle aperture;

an inner liner of resilient material bonded to said inner layer, said inner liner bounding an internal cavity defined by said shell; and a fastener assembly for releasably attaching said medial side portion to said lateral side portion for securing said skate shield to a boot portion of the ice skate.

9. The skate shield of claim 8 wherein the fastener assembly includes a strap having a first end portion rigidly affixed to one of said medial and lateral side portions of said shell, wherein a second end portion of said strap is releasably secured to a fastener associated with the other one of said medial and lateral side portions of said shell.

10. The skate shield of claim 8 wherein said fastener assembly includes a pair of clip retainers rigidly affixed to each of said medial and lateral side portions of said shell and a resilient ring that can be releasably secured to said clip retainers.

11. The skate shield of claim 8 wherein said medial side portion is configured to define a medial side section, a first heel flange section, wherein said lateral side portion is configured to define a lateral side section, and a second heel flange, wherein said bottom flange sections are spaced apart to define said bottom aperture therebetween, and wherein said first and second heel flanges are spaced apart to define said heel aperture.

12. A skate shield for use with an ice skate, comprising:

a shell having a medial side portion, a lateral side portion, and a top portion, wherein the medial side portion and the lateral side portion are interconnected by a top potion defining a toe aperture, the top portion and the medial and lateral side portions form an ankle aperture communication with a heel aperture, the medial and lateral side portions each configured to define a bottom flange section which cooperate to define a bottom aperture, said bottom aperture communicating with the toe aperture and the heel aperture and the ankle aperture, and the apertures are configured to receive the ice skate;

said bottom aperture configured to be substantially perpendicular to each of the toe aperture and the heel aperture;

a fastener assembly for releasably attaching the medial and lateral side portions for assembling the rigid shell to the ice skate, wherein the shell is made of at least one rigid outer layer of fiber reinforced material to provide stiffness to the shell and provided protection to the ice skate.

13. The skate shield of claim 12 wherein the at least one lateral of reinforced material includes an inner layer and an outer layer.

14. The skate shield of claim 13 wherein the inner layer and the outer layer includes a reinforced section.

15. The skate shield of claim 14 wherein reinforced section includes at least one reinforcing layer disposed between the inner layer and the outer layer to provide stiffness to the rigid shell.

16. The skate shield of claim 12 wherein the medial side portion is configured to define a medial side section and a first heel flange section, wherein the lateral side portion is configured to define a lateral side section and a second heel flange, wherein the bottom flange sections are spaced apart to define the bottom aperture therebetween, and wherein the first and second heel flanges are spaced apart to define the heel aperture.

17. A skate shield for use with an ice skate, comprising:

a shell having a medial side portion, a lateral side portion, and a top portion connecting the medial and lateral side portions, wherein the top portion and the medial and lateral side portions together define a toe aperture and an ankle aperture, the medial side portion and lateral side portion each defining a bottom flange section which together define a bottom aperture, said bottom aperture communicating with and configured to be substantially perpendicular to the toe aperture and a heel aperture, and the heel aperture communicating with the ankle aperture; and a fastener assembly for releasing connecting the medial and lateral side portions and enclosing the aperture;

wherein the shell includes a rigid outer layer, an inner layer and a reinforcing layer disposed between the outer and inner layers, and wherein at least one of the layers is made from a rigid fiber reinforced material, and an inner liner of resilient material bonded to an inwardly facing surface of said inner layer.

* * * * *